US005078265A

United States Patent [19]

Fugit et al.

[11] Patent Number: 5,078,265

[45] Date of Patent: Jan. 7, 1992

[54] LOTTERY TICKET HOLDER

[76] Inventors: Gary L. Fugit, 8325 E. Harry St., #503, Wichita, Kans. 67207; James L. Griswold, 811 Linden Ct., Wichita, Kans. 67206

[21] Appl. No.: 653,303

[22] Filed: Feb. 11, 1991

[51] Int. Cl.[5] ..... A45C 11/18

[52] U.S. Cl. ..... 206/39.6; 206/39.5; 40/488; 40/490; 40/491; 116/225; 116/321

[58] Field of Search ..... 206/39, 39.5, 39.6; 40/488, 490, 491; 283/903; 116/225, 321, 322, 323, 324

[56] References Cited

U.S. PATENT DOCUMENTS

| | | | |
|---|---|---|---|
| 1,194,360 | 8/1916 | Conley | 206/39.6 |
| 1,459,532 | 6/1923 | Harlan | 40/490 |
| 1,658,968 | 2/1928 | Carroll | 40/488 |
| 1,670,343 | 5/1928 | Clemens | 206/39.5 |
| 2,673,413 | 3/1954 | Weber | 116/225 |
| 3,106,029 | 10/1963 | Desmond | 40/488 |
| 3,431,885 | 3/1969 | Miklas | 40/491 |
| 4,032,004 | 6/1977 | Coates | 206/39.6 |
| 4,141,400 | 2/1979 | Mangan | 206/39.6 |
| 4,177,593 | 12/1979 | Lockey | 40/488 |
| 4,217,713 | 8/1980 | Greenberger | 40/488 |
| 4,233,768 | 11/1980 | Bromberg | 40/491 |
| 4,301,917 | 11/1981 | Ancell | 206/39.5 |
| 4,450,955 | 5/1984 | Featherston | 206/39.6 |
| 4,586,906 | 5/1986 | Buccieri, Jr. | 283/903 |
| 4,646,382 | 3/1987 | Smith | 283/903 |
| 4,835,889 | 6/1989 | McClymonds | 40/490 |
| 4,881,291 | 11/1989 | Ellis | 283/903 |
| 5,020,255 | 6/1991 | Rodel | 206/39.5 |

*Primary Examiner*—David T. Fidei
*Attorney, Agent, or Firm*—John Wade Carpenter

[57] ABSTRACT

A lottery ticket holder having a pair of planar members interconnected by and through a pair of partition (or side) members to form a hollow body wherethrough a lottery ticket slidably passes.

8 Claims, 2 Drawing Sheets

FIG. 1
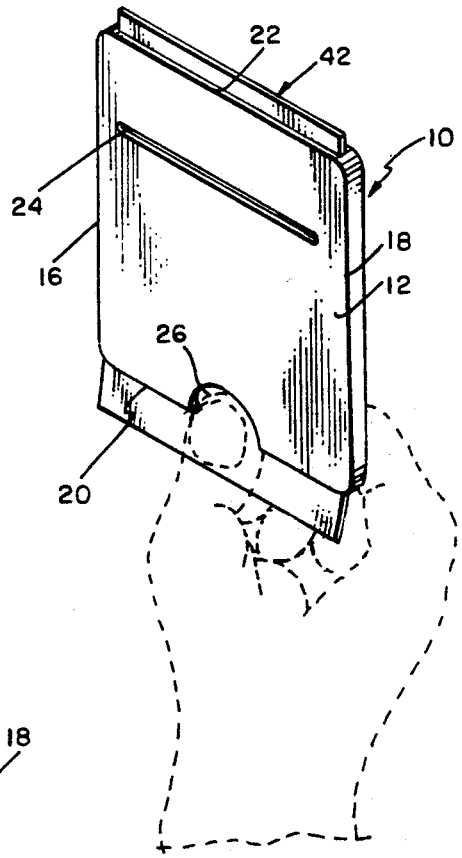
FIG. 2
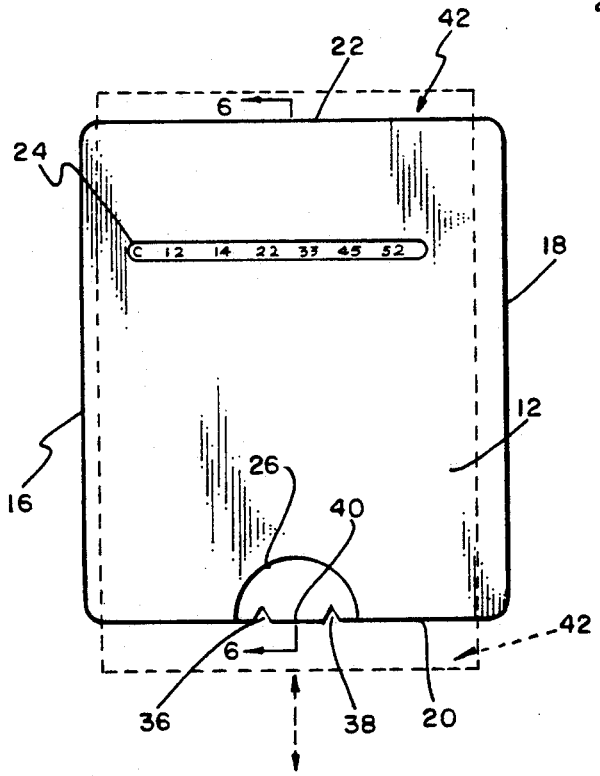
FIG. 4
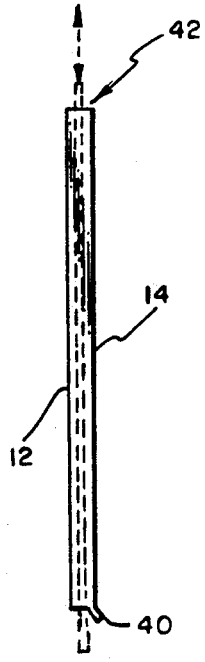
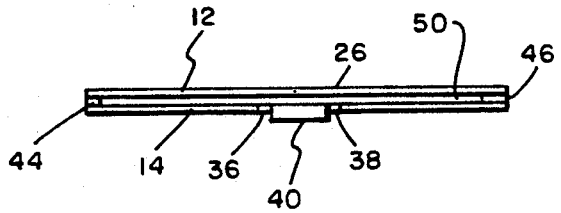
FIG. 3

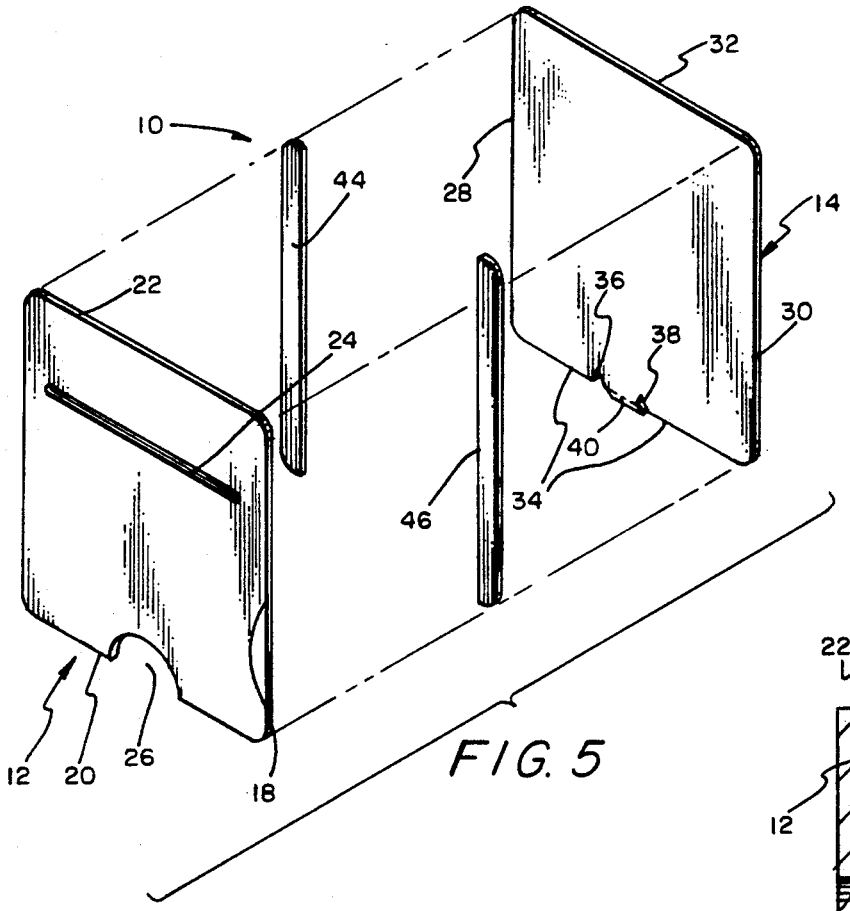
FIG. 5
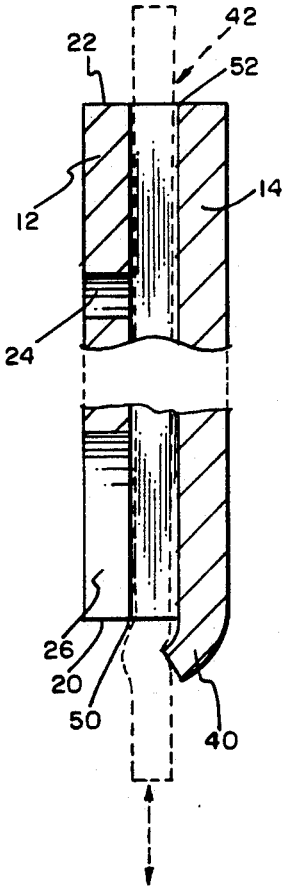
FIG. 6
FIG. 7
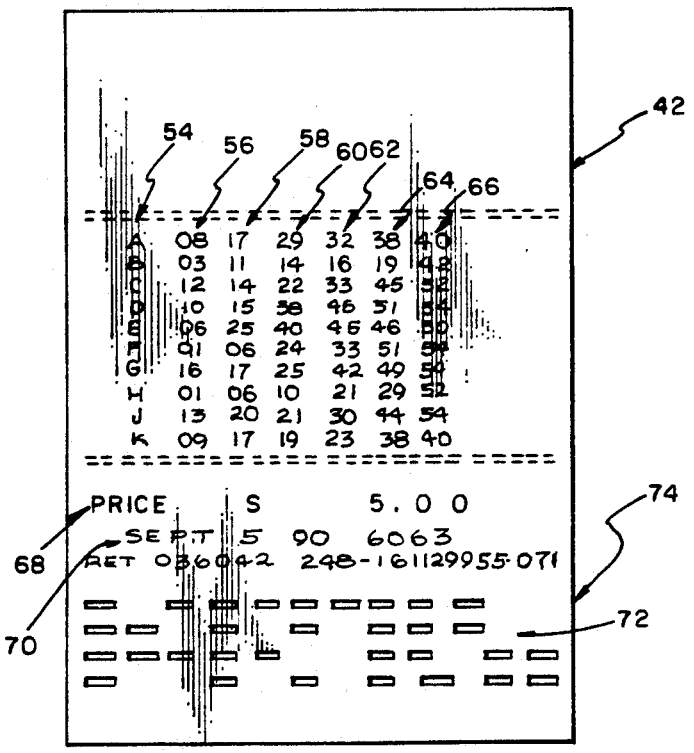

LOTTERY TICKET HOLDER

BACKGROUND OF THE INVENTION

1. Field of the Invention

This invention is related to a holder for tickets, cards, and the like. More particularly, this invention provides a lottery ticket holder.

2. Description of the Prior Art

A patentability investigation was conducted and the following prior art U.S. patents by Nos. were discovered: U.S. Pat. No. 4,586,906 to Buccieri Jr.; U.S. Pat. No. 4,646,382 to Smith; U.S. Pat. No. 4,654,923 to Faciane et al.; and U.S. Pat. No. 4,881,291 to Elles. None of these prior art U.S. patents teach the particular lottery ticket holder of the present invention.

SUMMARY OF THE INVENTION

The present invention accomplishes its desired objects by broadly providing a lottery ticket holder comprising a first planar member having a pair of first opposed longitudinal edges and a pair of first opposed transverse edges. The first planar member has a structure defining a generally longitudinally opening and a first aperture interrupting one of the first opposed transverse edges. The lottery ticket holder also comprises a second planar member having a pair of second opposed longitudinal edges and a pair of second opposed transverse edges. The second planar member has a structure defining a pair of second apertures interrupting one of the second opposed transverse edges and a deformed structure between the pair of second apertures defining a lip. A first partition member and a second partition member are provided. The first and said second partition members secure to the first and the second planar members in close proximity to the first opposed longitudinal edges and the second opposed longitudinal edges such that the combination of the first and the second planar members and the first and second partition members form a generally hollow body with a pair of opposed transverse body openings wherethrough a lottery ticket slidably passes. The first aperture is generally semi-circular, and the pair of second apertures and the lip are aligned over the first aperture such that the second aperture, and the lip are visible when the first planar member is viewed. A lottery ticket is slidably disposed in the hollow body.

The lottery ticket holder is particularly suited for a lottery ticket which comprises a first column of alphabetical indicia; and a second, a third, a fourth, a fifth, a sixth and a seventh column, with each column comprising a plurality of a set of numbers. The lottery ticket additionally comprises price indicia representing the price of the lottery ticket and date indicia representing the date of the lottery ticket. The lottery ticket preferably additionally includes bar code indicia.

It is therefore an object of the present invention to provide a lottery ticket holder.

These, together with the various ancillary objects and features which will become apparent to those skilled in the art as the following description proceeds, are attained by this novel apparatus and method for holding a lottery ticket, a preferred embodiment being shown with reference to the accompanying drawings, by way of example only, wherein;

BRIEF DESCRIPTION OF THE DRAWINGS

FIG. 1 is a perspective view of the lottery ticket holder of the present invention;

FIG. 2 is a top plan view of the lottery ticket holder;

FIG. 3 is an end elevational view of the lottery ticket holder;

FIG. 4 is a side elevational view of the lottery ticket holder;

FIG. 5 is an exploded, segmented perspective view of the lottery ticket holder;

FIG. 6 is a partial vertical sectional view taken in direction of the arrows and along the plane of line 6—6 in FIG. 2; and FIG. 7 is a top plan view of a lottery ticket to be held by the lottery ticket holder.

DETAILED DESCRIPTION OF THE INVENTION

Referring in detail now to the drawings wherein similar parts of the invention are identified by like reference numerals, there is seen a lottery ticket holder, generally illustrated as 10, that includes a pair of generally rectangular, flat planar members 12 and 14. Member 12 has a pair of longitudinal edges 16 and 18 and a pair of transverse (or end/side) edges 20 and 22. The member 12 also has a generally elongated opening 24 wherethrough lottery numbers or indicia are to be viewed, and a generally semi-circular aperture or recess opening 26 that interrupts transverse edge 20.

The member 14 has a pair of longitudinal edges 28 and 30 and a pair of transverse (or side/end) edges 32 and 34. Edge 34 has a structive and is interrupted by a pair of apertures 36 and 38. Between the apertures 36 and 38 the edge 34 has a deformed structure defining a lip 40 which is to function for selectively scraping a surface layer from the face of a lottery ticket, generally illustrated as 42, similar to the blade 22 of U.S. Pat. No. 4,881,291 incorporated herein by reference thereto. The lip 40 may be formed to protrude in either of two directions, (i.e. either towards planar member 12 as shown in FIG. 6 or away from planar member 12 as shown in FIGS. 3 and 4).

The lottery ticket holder 10 additionally comprises partition members 44 and 46 (see FIG. 5). Partition member 44 secures to the back planar faces of members 12 and 14 in close proximity to edges 16 and 28 such as to collimate and register with all of the same. Similarly, partition member 46 also secures to the back planar faces of members 12 and 14 in close proximity to edges 18 and 30 such as to collimate or register with all of the same. When the members 12 and 14 and the partition members 44 and 46 all combine and interconnect as such, the combination forms a generally hollow body with a pair of opposed transverse body openings 50 and 52 wherethrough the lottery ticket 42 slidably passes. When the members 12 and 14 and the partition members 44 and 46 are all combined and interconnected as such, the apertures 36 and 38 and the lip 40 are aligned over (and within the confines of) the recess opening 26 such that the apertures 36, 38 and the lip 40 are visible when the member 12 is directly (or normally) viewed (see FIG. 2), and when the lottery ticket 42 is not disposed within the lottery ticket holder 10.

The lottery ticket holder 10 is particularly ideally suited for slidably engaging those conventional lottery tickets 42 having a column 54 of alphabetical indicia (i.e., "A", "B", "C", "D", "E", "F", "G", "H", "I", "J", "K", and so on); and columns 56, 58, 60, 62, 64 and 66 where each of these columns has a plurality or a plural set of numbers. Each set has two (2) numbers as shown in FIG. 7. The lottery ticket 42 also has price indicia 68 representing the price or cost of the ticket 42; date indicia 70 representing when the ticket 42 ways purchased; and bar code indicia 72 for processing-/verification purposes. The ticket 42 may also have other indicia 74.

The ticket 42 is slid through the openings 50 and 52 such that any desired alphabetical letter and associated sets of pair of numbers from columns 56, 58, 60, 62, 64 and 66 are readily discernible through opening 24 (e.g. as best shown in FIG. 2 by way of example only, "C 12 14 22 33 45 52"). Movement of the ticket 42 in any direction exposes the next available row (e.g. "B 03 11 14 16 19 42" or "D 10 15 38 46 51 54"). The lip 40 is available for scratching any surface layer from the face of the lottery ticket 42.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

We claim:

1. A lottery ticket holder comprising a first planar member having a pair of first opposed longitudinal edges and a pair of first opposed transverse edges, said first planar member having a structure defining a generally longitudinally opening and a first aperture interrupting one of the first opposed transverse edges; a second planar member having a pair of second opposed longitudinal edges and a pair of second opposed transverse edges, said second planar member having a structure defining a pair of secured apertures interrupting one of the second opposed transverse edges and a deformed structure between the pair of second apertures defining a lip; a first partition member; and a second partition member; said first and said second partition members securing to the first and the second planar members in close proximity to the first opposed longitudinal edges and the second opposed longitudinal edges such that the combination of the first and the second planar members and the first and second partition members forms a generally hollow body with a pair of opposed transverse body openings wherethrough a lottery ticket slidably passes.

2. The lottery ticket holder of claim 1 wherein said first aperture is generally semi-circular.

3. The lottery ticket holder of claim 2 wherein said pair of second apertures and said lip are aligned over the first aperture such that the second aperture, and the lip are visible when the first planar member is viewed.

4. The lottery ticket holder of claim 3 additionally comprising a lottery ticket slidably disposed in said hollow body.

5. The lottery ticket holder of claim 4 wherein said lottery ticket comprises a first column of alphabetical indicia; and a second, a third, a fourth, a fifth, a sixth and a seventh column, with each column comprising a plurality of a set of numbers.

6. The lottery ticket holder of claim 5 wherein said lottery ticket additionally comprises price indicia representing the price of the lottery ticket.

7. The lottery ticket holder of claim 6 wherein said lottery ticket comprises date indicia representing the date of the lottery ticket.

8. The lottery ticket holder of claim 7 wherein said lottery ticket comprises bar code indicia.

* * * * *